US010060388B2

(12) United States Patent
Clark et al.

(10) Patent No.: US 10,060,388 B2
(45) Date of Patent: Aug. 28, 2018

(54) STIRLING ENGINE

(71) Applicant: Microgen Engine Corporation Holding BV, Doetinchem (NL)

(72) Inventors: David Anthony Clark, Huntingdon (GB); Adam Henry Green, Spalding (GB)

(73) Assignee: Microgen Engine Corporation Holding B.V., Doetinchem (NL)

( * ) Notice: Subject to any disclaimer, the term of this patent is extended or adjusted under 35 U.S.C. 154(b) by 229 days.

(21) Appl. No.: 14/896,539

(22) PCT Filed: Mar. 11, 2014

(86) PCT No.: PCT/EP2014/054667

§ 371 (c)(1),
(2) Date: Dec. 7, 2015

(87) PCT Pub. No.: WO2014/198430

PCT Pub. Date: Dec. 18, 2014

(65) Prior Publication Data

US 2016/0131076 A1 May 12, 2016

(30) Foreign Application Priority Data

Jun. 12, 2013 (GB) ..... 1310449.2

(51) Int. Cl.
*F02G 1/055* (2006.01)
*F02G 1/043* (2006.01)
*F02G 1/053* (2006.01)

(52) U.S. Cl.
CPC ..... *F02G 1/0435* (2013.01); *F02G 1/053* (2013.01); *F02G 1/055* (2013.01); *F02G 2254/40* (2013.01); *F05C 2251/04* (2013.01)

(58) Field of Classification Search
CPC .. F02G 1/0435; F02G 1/053; F02G 2270/005; F03G 6/068
See application file for complete search history.

(56) References Cited

U.S. PATENT DOCUMENTS 3,224,187 A * 12/1965 Breihan ..... F02G 1/055 60/526
2003/0121259 A1* 7/2003 Conrad ..... F02G 1/0435 60/508
2012/0312017 A1 12/2012 Fraser

FOREIGN PATENT DOCUMENTS

JP 2007003130 A * 1/2007
JP 2011202631 A 10/2011

OTHER PUBLICATIONS

Machine translation of JP 2007003130 A, accessed Sep. 28, 2017.*
Coniglio, Carlo; International Search Report from PCT/EP2014/054667; dated Jun. 23, 2014; pp. 1-2, European Patent Office, Munich, Germany.

(Continued)

*Primary Examiner* — Jonathan Matthias
(74) *Attorney, Agent, or Firm* — Ballard Spahr LLP

(57) ABSTRACT

A Stirling engine has a housing containing a displacer and a power piston arranged to reciprocate relatively to one another. A head is adjacent to the displacer to absorb heat, and is surrounded by a block of copper or aluminum. A substantial proportion of the block is clad with a layer of stainless steel or Inconel having a thickness of between 3 mm and 0.15 mm.

11 Claims, 2 Drawing Sheets

(56) References Cited

OTHER PUBLICATIONS

Figure 1:
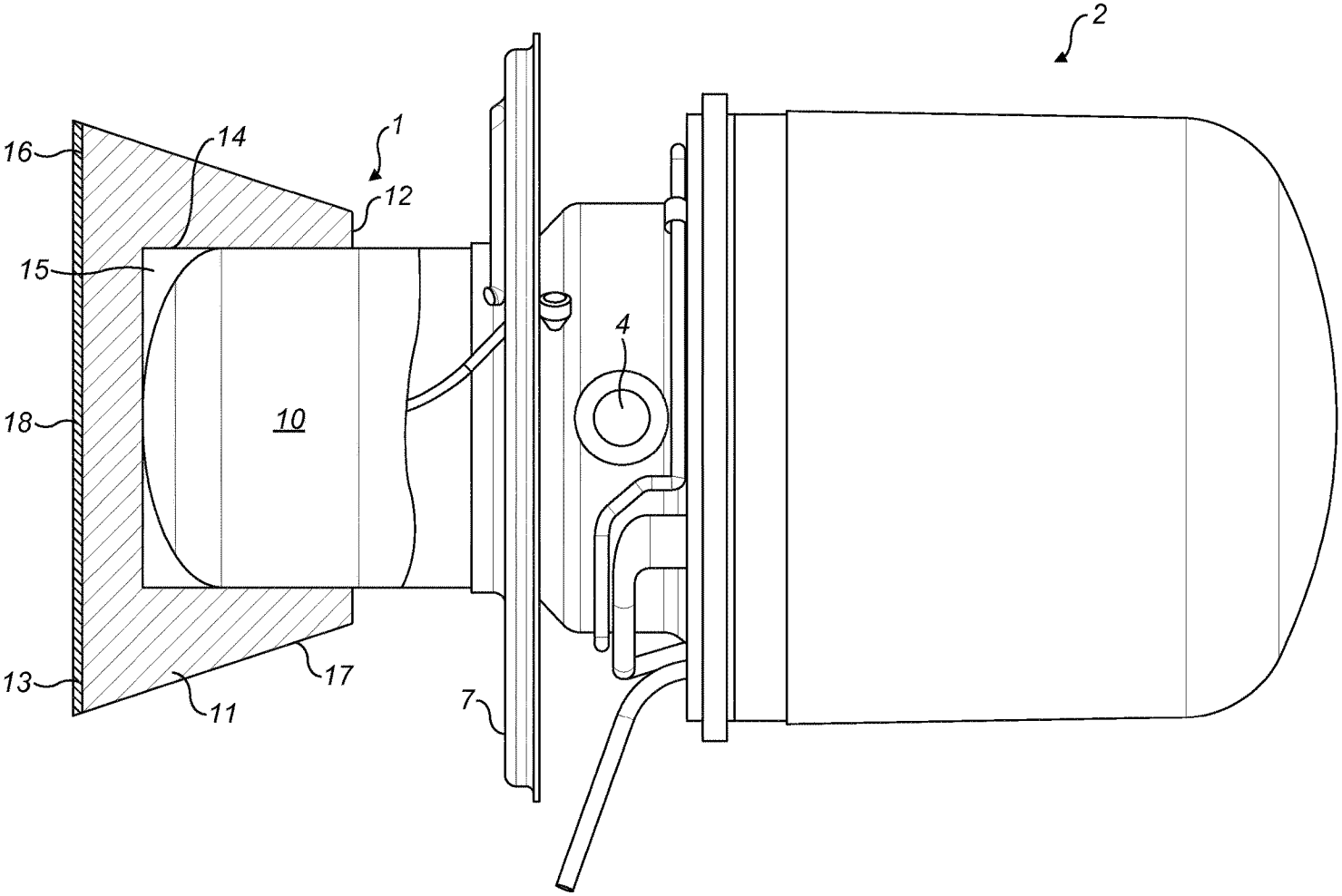

Coniglio, Carlo, Written of the International Searching Authority from PCT/EP2014/054667; Jun. 23, 2014; pp. 1-3, European Patent Office, Munich, Germany.
Middleton, Peter, Search Report from priority patent application No. GB1310449.2; dated Dec. 12, 2013, pp. 1-3, Intellectual Property Office, South Wales.

* cited by examiner

STIRLING ENGINE

CROSS REFERENCE TO RELATED APPLICATIONS

This application is a national phase filing of International patent application No. PCT/EP2014/054667, filed Mar. 11, 2014, which claims priority to GB1310449.2, filed on Jun. 12, 2013, both of which are herein incorporated by reference in their entireties.

The present invention relates to a Stirling engine.

Stirling engines are temperature driven Carnot machines which work best when they have a constant high temperature and a high enough heat input through their heads. Thus, they are ideally suited to being heated by a gas burner which can always provide enough heat at a high temperature. The applicant has developed and is producing such a Stirling engine (the Microgen™ lkWe engine) suitable for use in the domestic environment to provide electricity and hot water. The gas burner is designed to provide high temperature heat to the optimum location, opposite to the internal and external acceptor fins of the Stirling engine.

The engines are also well suited to being used in remote locations as they are sealed units which have a long life span and require little or no maintenance. However, away from the guaranteed supply of gas, the fuels which are available, such as biomass, waste heat and solar are not able to generate heat in the same constant manner as a mains gas supply.

One attempt to solve this problem has been to encase the Stirling engine head in a block of copper brazed to the head where the external fins normally attach. The copper has high thermal conductivity and therefore provides increased surface area and good heat transfer into the head. Further, its mass provides a thermal inertia to smooth out any variations in the heat supply.

This does not, however, provide a workable solution as copper oxide rapidly builds up in the outer surface of the copper block which, in a very short space of time, reduces its heat transfer capability to an unacceptable level.

According to the present invention there is provided a Stirling engine comprising a housing containing a displacer and a power piston arranged to reciprocate relatively to one another, a head adjacent to the displacer to absorb heat, the head being surrounded by a block of copper or aluminum, a substantial proportion of the block being clad with a layer of stainless steel or INCONEL (nickel alloy) having a thickness of between 3 mm and 0.15 mm.

Taking the apparently counterproductive step of using a material with low thermal conductivity, the present invention provides, for the first time, a successful Stirling engine which can be used when the heat source which is at a lower temperature and difficult to direct and control.

The high thermal conductivity of the block of copper or aluminium reduces the temperature drop through the block, reducing the average temperature of the block for a given engine power and head operating temperature. Typically, the copper will have a thermal conductivity of approximately 400 W/mK and aluminium with approximately 200 W/mK. This increased mass helps maintain and control steadier temperatures by having a substantial thermal mass and provides slower time constraints and much more time before the head is overheated or cools down. This is required in systems where the heat source is not accurately controllable and allows much more time for control actions on the heat source.

The increased surface area from the head reduces heat fluxes and lowers surface temperature. This allows less exhaustive and hence less expensive cladding material to be used.

The block of copper or aluminium is required to be reasonably large in order to have the necessary thermal inertia and surface area. The actual dimensions of the block will depend upon the size of the engine and the heat source. However, preferably, the block has a maximum distance from the outermost surface to the closest part of the housing of greater than 1 cm. This effectively requires that the minimum thickness of the block is at least 1 cm.

Similarly, the exact thickness of the cladding layer depends upon operational parameters. However, the thickness is preferably 1 mm to 0.5 mm.

The block may have a generally frustoconical shape arranged coaxially with the head and with the wider end of the block furthest from the head where it provides a circular face. This frustoconical shape presents a wide circular face facing away from the head which particularly suitable for absorbing solar radiation.

Preferably, only the circular face of the block at the wider end is clad. This is the surface which will experience the highest temperatures and therefore the benefit from the cladding protection. Also, the conically curved face beneath the circular face is more difficult to clad. This face is preferably brazed.

For a non-solar source, a block with a substantially cylindrical configuration is preferred. In this case, the majority of the heat is absorbed through the top and side surfaces of the block. The side and top surfaces are preferably clad.

The Stirling engine may be any form of Stirling engine, but is preferably a free piston engine and is preferably a linear engine.

Figure 2:
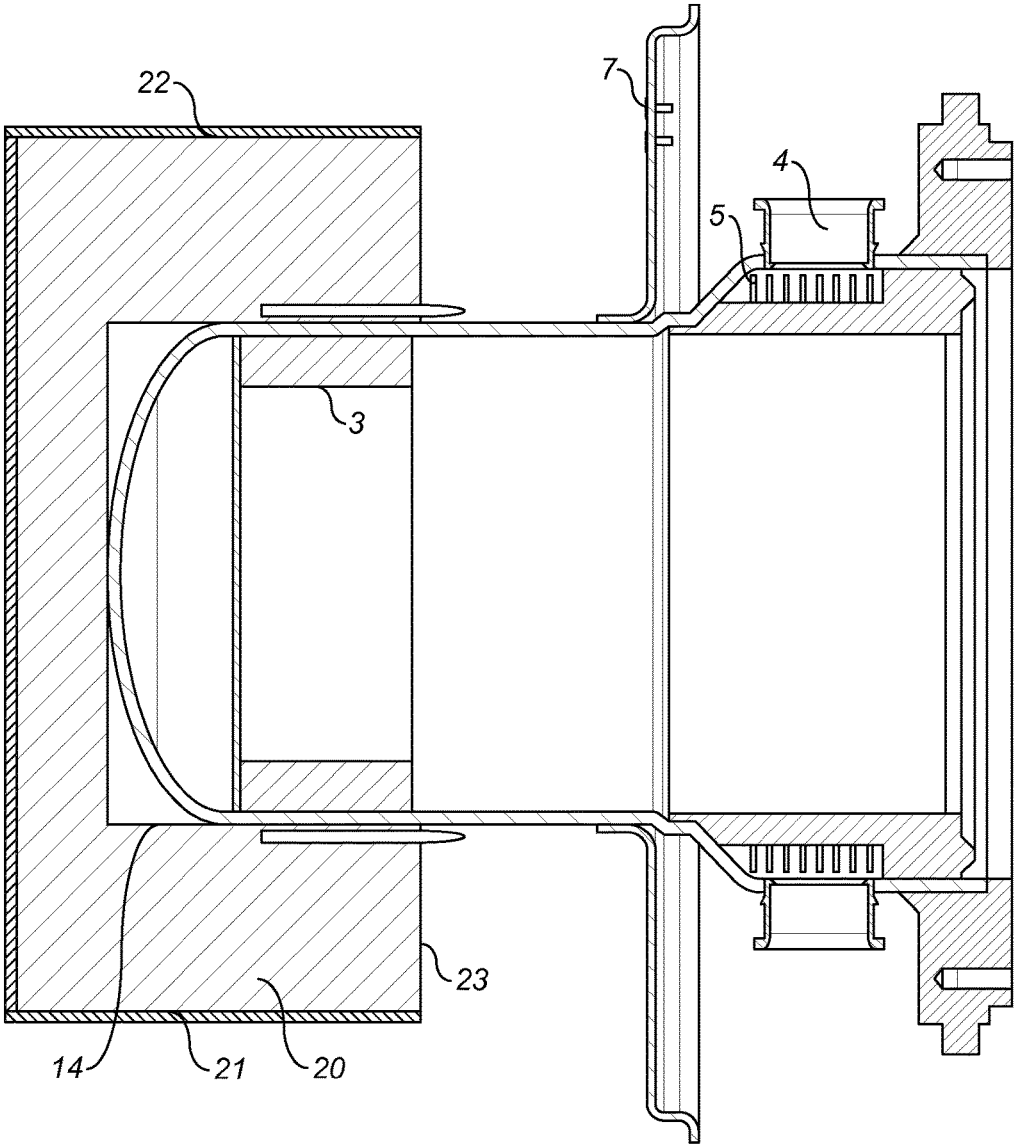

Examples of Stirling engines in accordance with the present invention will now be described with reference to the accompanying drawings, in which:

FIG. 1 is a side view of the Stirling engine with the head portion shown in cross-section for use with a solar source; and FIG. 2 is a cross-section through the head end of a Stirling engine casing for an engine used for a biomass or waste heat source.

The basic design of the Stirling engine is known in the art, for example, the Microgen™ 1 kW engine. The engine is a linear free piston Stirling engine with a displacer (not shown) adjacent to the head end 1 and a power piston (not shown) adjacent to the opposite end 2. Heat is applied at the head end 1. This heat is absorbed by internal fins 3 as shown in FIG. 2. A coolant circuit surrounds a central portion of the engine. This comprises coolant inlet 4 and an inner coolant chamber 5 around which the coolant circulates in order to create a heat differential between the head and the central portion of the engine. This differential causes reciprocation of the displacer in a manner well known in the art. The displacer reciprocates out of phase with the power piston and an AC output is provided at the opposite end 2. The water in the coolant circuit is then fed to a heat exchanger (not shown) where it absorbs exhaust heat from the engine to provide a heat supply.

An annular flange 7 surrounds a central portion of the engine and is the means by which the engine is supported again as is known in the art.

The present invention is directed to the provision of a block adjacent to the head to facilitate heat absorption for particular sources.

In FIG. 1, the head 10 is surrounded by a block 11 having a generally frustoconical shape with a narrow annular end 12 and a wide circular end 13 with a cylindrical recess 14 extending centrally from the narrow end 12 of the block 11 most of the way to the wider end. At the end of the recess 14, a space 15 defined between the curved top of the head and the block 11. This is done firstly because there is little heat transfer which occurs at this point, and secondly because the cylindrical shape shown in FIG. 1 is easier to machine.

The block 11 is made of copper or aluminum and the circular top face is clad with a circular disc 18 of stainless steel or INCONEL (nickel alloy) having a thickness of between 3 mm and 1.5 mm. The curved face 17 of the copper block 14 and under the cladding 13 and the narrow end 12 are brazed with nickel.

In use, a solar collector is provided to direct solar energy onto the circular end 13 such that this energy is absorbed into the block 11 and hence into the head 10. It will be appreciated that the relatively large size of the block and the use of copper or aluminium provides a large thermal mass which optimizes the heat absorption into the head. Secondly, the large thermal mass provides a degree of smoothing for this otherwise unpredictable heat source.

FIG. 2 shows a similar block suitable for a non-solar application. In this case, the block 20 is cylindrical but has a similar central recess 14 accommodating the head. In this case, both the circular end face 21 and the annular side face 22 are clad with a layer of stainless steel or INCONEL (nickel alloy) having a thickness of between 3 mm and 0.15 mm as the heat transfer is more evenly distributed around the surfaces. The end surface 23 of the block closest to the mounting bracket 7 does not need to be clad as it does not receive significant direct heat. However, the heat could be clad if required.

The typical thermal properties of the materials used are set out below:

| Material | Thermal Conductivity1 W/m K | Density kg/m3 | Specific Heat kJ/Kg K |
|---|---|---|---|
| Copper | 400 | 8960 | 0.3785 |
| Stainless Steel (304) | 16 to 20 | 8030 | 0.5 |

-continued

| Material | Thermal Conductivity1 W/m K | Density kg/m3 | Specific Heat kJ/Kg K |
|---|---|---|---|
| Aluminium | 205 | 2700 | 0.897 |
| Inconels (Nickel alloys) | 16 | 8430 | N/A |

The invention claimed is:

1. A Stirling engine comprising a housing containing a displacer and a power piston arranged to reciprocate relatively to one another, a head adjacent to the displacer to absorb heat, the head being surrounded by a block of copper or aluminum, a proportion of an exposed outer surface of the block being clad with a layer of stainless steel or INCONNEL (nickel alloy) having a thickness of between 3 mm and 0.15 mm.

2. An engine according to claim 1, wherein the block has a maximum distance from the outermost surface to the closest part of the housing of greater than 1 cm.

3. An engine according to claim 1, wherein the thickness of the cladding layer is 1 mm to 0.5 mm.

4. An engine according to claim 1, wherein the block has a frustoconical shape, arranged coaxially with the head and with the wider end of the block furthest from the head where it provides a circular face.

5. An engine according to claim 4, wherein only the circular face of the block at the wider end is clad.

6. An engine according to claim 5, wherein the conical face of the block is brazed with nickel.

7. An engine according to claim 1, wherein the block has a cylindrical shape arranged coaxially with the head.

8. An engine according to claim 7, wherein top and/or the side faces of the block are clad.

9. An engine according to claim 1, wherein the engine is a free piston engine.

10. An engine according to claim 1, wherein the engine is a linear engine.

11. A combination of an engine according to claim 1, with a biomass, waste heat or solar heat source arranged to supply heat to the head via the block and cladding.

* * * * *